US007966695B2

(12) United States Patent
Salice

(10) Patent No.: US 7,966,695 B2
(45) Date of Patent: Jun. 28, 2011

(54) HINGE

(75) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 560 days.

(21) Appl. No.: 11/886,386

(22) PCT Filed: Jan. 24, 2006

(86) PCT No.: PCT/EP2006/000611

§ 371 (c)(1),
(2), (4) Date: Mar. 21, 2008

(87) PCT Pub. No.: WO2006/097157

PCT Pub. Date: Sep. 21, 2006

(65) Prior Publication Data

US 2008/0209681 A1 Sep. 4, 2008

(51) Int. Cl.
*E05F 1/08* (2006.01)

(52) U.S. Cl. ..... 16/286; 16/297; 16/335; 312/326

(58) Field of Classification Search ..... 16/286, 16/287, 296, 297, 335, 342, 235, 242; 297/229, 297/47, 36.1; 267/229, 36.1, 47; 312/326
See application file for complete search history.

(56) References Cited

U.S. PATENT DOCUMENTS 3,705,718 A * 12/1972 Fukui et al. ..... 267/47
4,177,540 A * 12/1979 Gorton ..... 16/335
4,546,958 A * 10/1985 Ohno et al. ..... 267/47
4,662,579 A * 5/1987 Gelardi et al. ..... 242/345.2
4,716,622 A 1/1988 DeBruyn
5,008,977 A 4/1991 Lautenschlager et al.
5,027,474 A * 7/1991 Bowers ..... 16/297
5,517,724 A * 5/1996 Beneke ..... 16/335
(Continued)

FOREIGN PATENT DOCUMENTS

DE 2550574 A * 5/1977
(Continued)

OTHER PUBLICATIONS

ISA Germany, International Search Report of PCT/EP2006/000611, Apr. 7, 2006, 3 pages.

*Primary Examiner* — William L. Miller
(74) *Attorney, Agent, or Firm* — Alleman Hall McCoy Russell & Tuttle LLP

(57) ABSTRACT

The invention relates to a hinge, preferably a furniture hinge, comprising a hinge arm which is pivotably supported on a joint axle which is non-displaceably held in a cup-shaped hinge part and which is provided with a tongue projecting beyond the joint axle or with a cam eccentric with respect to the joint axle or with a control edge which slide on a leaf spring whose one end region is held at the pivotable hinge part and which generates a closing torque in the closing region. In accordance with the invention, the leaf spring has at least two portions of different widths, with the at least one narrower portion of the leaf spring passing through a center recess of the hinge arm, with a tongue being cut from the lower edge of said recess. The at least one wider portion of the leaf spring is pressed against the base of the hinge cup by a transversely extending pin and thus fixedly held by a transversely extending pin.

20 Claims, 4 Drawing Sheets

U.S. PATENT DOCUMENTS

| | | | | |
|---|---|---|---|---|
| 5,546,956 | A | 8/1996 | Thornton | |
| 5,604,956 | A | 2/1997 | Grass | |
| 5,617,612 | A * | 4/1997 | Ferrari et al. | 16/278 |
| 6,049,946 | A * | 4/2000 | Cress et al. | 16/240 |
| 6,289,556 | B1 * | 9/2001 | Salice | 16/335 |
| 6,360,401 | B1 * | 3/2002 | Salice | 16/335 |
| 6,393,663 | B1 | 5/2002 | Lin | |
| 7,003,851 | B2 * | 2/2006 | Salice | 16/285 |
| 2008/0250604 | A1 * | 10/2008 | Chen et al. | 16/225 |

FOREIGN PATENT DOCUMENTS

| | | | |
|---|---|---|---|
| DE | 3601682 | A1 | 7/1987 |
| DE | 93 06 820.4 | | 8/1993 |
| DE | 0987394 | A2 | 3/2000 |

* cited by examiner

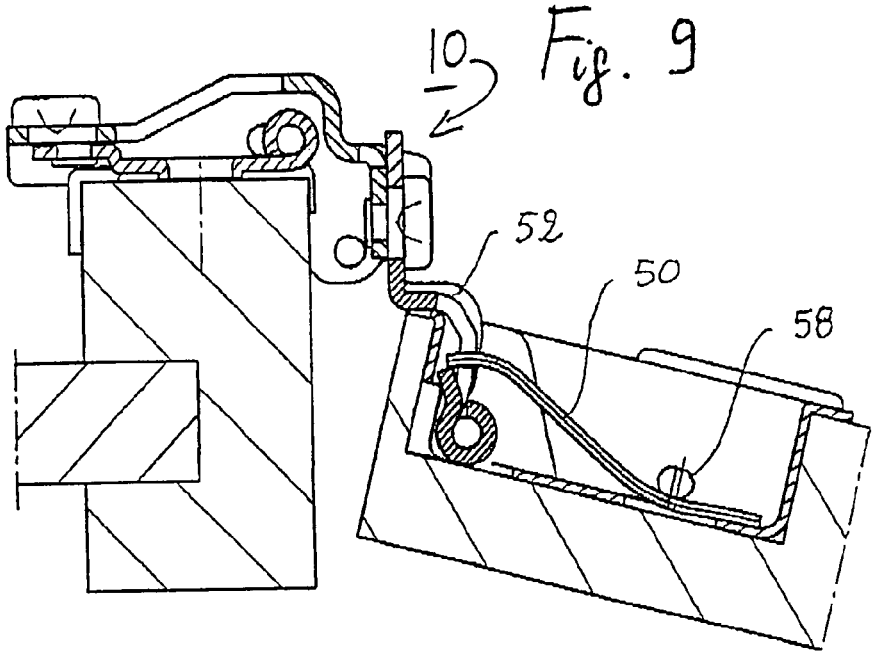
Fig. 9
Fig. 10
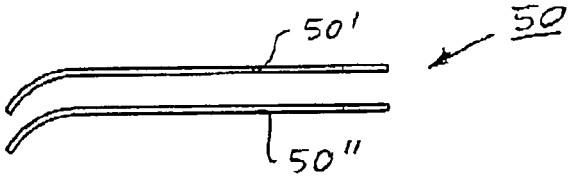
Fig. 11
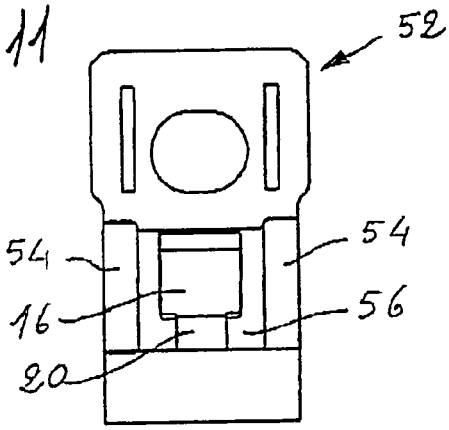
Fig. 12
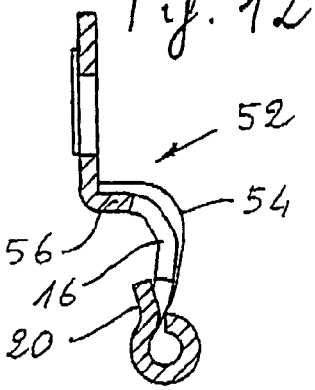

HINGE

CROSS-REFERENCE TO RELATED APPLICATIONS

This is the U.S. national phase of International PCT Application Ser. No. PCT/EP2006/000611 filed Jan. 24, 2006, which turn claims priority U.S. patent application Ser. No. 11/080,003 filed Mar. 14, 2005, now abandoned, both of which applications are hereby incorporated by reference in their entirety for all purposes.

STATEMENT REGARDING FEDERALLY SPONSORED RESEARCH OR DEVELOPMENT Not Applicable

THE NAMES OF THE PARTIES TO A JOINT RESEARCH AGREEMENT Not Applicable

INCORPORATION-BY-REFERENCE OF MATERIAL SUBMITTED ON A COMPACT DISC Not Applicable

BACKGROUND OF THE INVENTION

The invention relates to a hinge, preferably a furniture hinge, comprising a hinge arm which is pivotably supported on a joint axle which is non-displaceably held in a cup-shaped hinge part and which is provided with a tongue projecting beyond the joint axle or with a cam eccentric with respect to the joint axle or with a control edge which slide on a leaf spring whose one end region is held at the pivotable hinge part and which generates a closing torque in the closing region.

A hinge of the type previously set forth and known from DE 36 01 682 A1 has a leaf spring whose bent end is held in a slot of the base of a cup-shaped hinge part and whose middle part is supported against a spigot projecting laterally into the hinge cup such that the resilient end of the leaf spring acts on a control edge of the hinge arm. The lateral edge of the leaf spring reduces the width of the hinge arm and therefore also the strength of the total hinge. The lateral arrangement of the leaf spring means that it can only be made in narrow form. It follows from this that no large closing torque can be generated.

An embodiment of the initially explained hinge is known from U.S. Pat. No. 5,546,956 A in which the leaf springs have two-sided tongues which are likewise made narrow and wherein the leaf spring itself is only fixedly held at the base hinge cup by a rivet. This likewise means that the leaf spring disclosed there cannot exert any great closing torque. Furthermore, the leaf spring generating the closing torque requires a lot of space in the hinge cup so that such a hinge cannot be considered for compact embodiments which are desired, for example, in thin doors.

A wire spring which is fastened in a complex manner beneath the base hinge cup is provided as the spring member generating the closing torque in U.S. Pat. No. 5,604,956 A. The free ends of the wire spring project from lateral recesses into the inner space of the hinge cup and are supported at side cams of the hinge arm. This embodiment is very complex and expensive and its effect corresponds to a hinge in accordance with the European Patent EP 0 987 394 B1 which originates from the same applicant as the present invention.

A leaf spring having a narrow and a wide region is shown in U.S. Pat. No. 4,716,622, with one end of the narrow region acting on the lower edge of the hinge arm wound around this joint axle which thus acts as a control edge. However, the spring hereby acts only in a small region of movement onto the control edge which moreover only has the thickness of the hinge arm and thus forms a poor lever. The leaf spring is moreover held by a bent over lug and two lateral bolts extending at right angles, with it being supported beneath the base of the hinge cup and therefore having to pass through a required recess so that its mounting is very complex and/or expensive.

It is the object of the present invention to further develop a generic hinge having components such as a hinge arm and a hinge cup which are easy to manufacture such that a leaf spring which generates the closing torque can be fastened more simply and thus in an economical manner in the cup-shaped hinge part, with the spring properties of the leaf spring simultaneously being utilized in the best possible manner to achieve a better function of the hinge.

This object is solved by the claimed features of claim 1. Accordingly, a hinge comprises a hinge arm which is pivotably supported on a joint axle non-displaceably held in a cup-shaped hinge part. The hinge is provided with a tongue which projects beyond the joint axle or with a cam eccentric with respect to the joint axle or with a control edge which slides on a leaf spring whose one end region is held at the pivotable hinge part and which generates a closing torque in the closing region. In accordance with the invention, the leaf spring has at least two portions of different widths, with at least one narrower portion of the leaf spring passing through a center recess of the hinge arm, with a tongue being cut out of the lower edge of said center recess, and at least one wider portion of the leaf spring being pressed against the base of the hinge cup by a transversely extending pin and thus being fixedly held.

Preferred embodiments of the invention result from the dependent claims following on from the main claim.

Accordingly, the at least one narrower portion of the leaf spring can have an elongate rib up to the transition region of the least one wider portion of the leaf spring. This means that the rib extends along the leaf spring. Due to this longitudinally extending rib, the bending of the leaf spring does not take place in its narrower portion, but rather in the wider portion which is held at the base of the hinge cup. The leaf spring absorbs a large force with a lower bend in this wider portion and in the transition region leading to it and its service life is in no way influenced by possible microbreaks originating from the production process. Furthermore, notches or cut-outs can also be present which give the spring the desired shape and which, however, can only insignificantly reduce the spring force due to the rib.

The at least one wide portion of the leaf spring can advantageously be pressed against the base of the hinge cup by a transversely extending pin and can thus be fixedly held.

The base of the hinge cup advantageously has a recess in the region in which the at least one wider portion of the leaf spring is arranged. The spacing between the transversely extending pin and the base can be dimensioned to be smaller than the thickness of the leaf spring. The leaf spring can have a transversely extending dimple at its region disposed beneath the transversely extending pin which optionally dips into the recess of the hinge cup and thus holds the leaf spring in its correct and centered position.

The longitudinally extending rib can extend up to three-quarters of the length of the transition region between the two portions of the leaf spring at least present.

In accordance with a further preferred aspect of the invention, the hinge arm can have a recess from whose lower edge the tongue is cut out such that the lower edge of the recess has two portions next to the cut-out tongue onto which the leaf spring can be supported in the fully open position of the hinge. The spacing of the two portions from the joint axle can be equal to or only slightly larger than the spacing of the outer edge of the tongue from the joint axle. While the leaf spring is therefore supported on the tongue during the opening and closing of the hinge, it is supported on the additional two portions in the completely open position of the hinge.

In accordance with a further preferred aspect, the leaf spring can comprise two identical leaf springs of small thickness. In this case, the rib provided alternatively for reinforcement can be omitted. Corresponding dimples or beads also do not have to be provided in this embodiment.

In accordance with a further preferred aspect of the invention, the transverse pin can have an out of round cross-section. The transverse pin is hereby reinforced such that it does not sag as simply as a transverse pin with a circular cross-section.

The hinge arm preferably has edges in its curved region which are shaped such that they are offset with respect to the center part of the hinge arm provided with the recess. These shaped parts are therefore not disposed in the same plane as the remainder of the hinge arm. The strength of the hinge arm is substantially improved by this shape.

BRIEF DESCRIPTION OF THE SEVERAL VIEWS OF THE DRAWINGS

Further features, details and advantages of the invention will be shown with reference to an embodiment illustrated in more detail in the drawing. There are shown:

FIG. 9: a view corresponding to FIG. 3 of an alternative aspect of the invention;

FIG. 10: a detail of a component of the hinge in accordance with the invention;

FIG. 11: a plan view corresponding to FIG. 7 of a hinge arm of different construction; and FIG. 12: a sectional view of the hinge arm of FIG. 11.

DETAILED DESCRIPTION OF THE INVENTION

Figure 1:
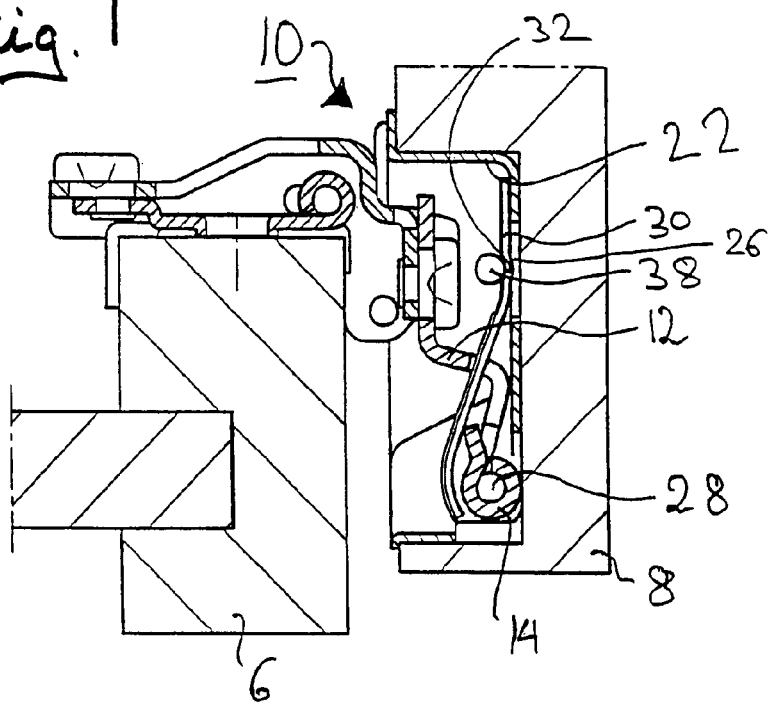
FIG. 1: a longitudinal section through a hinge in accordance with the invention in the closed state.
Figure 2:
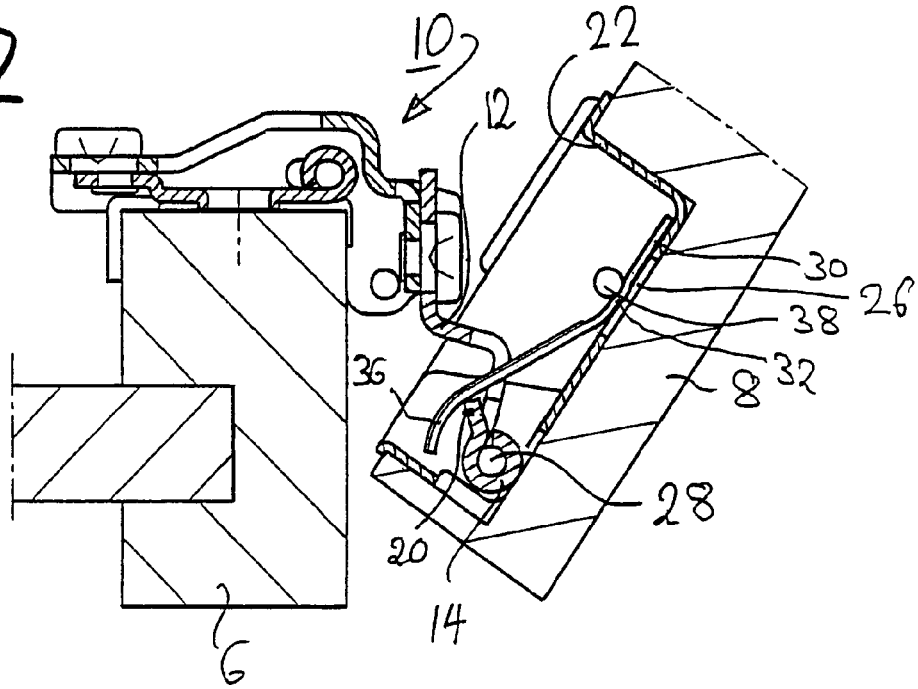
FIG. 2: the hinge of FIG. 1 in a state opened by approx. 30°.
Figure 3:
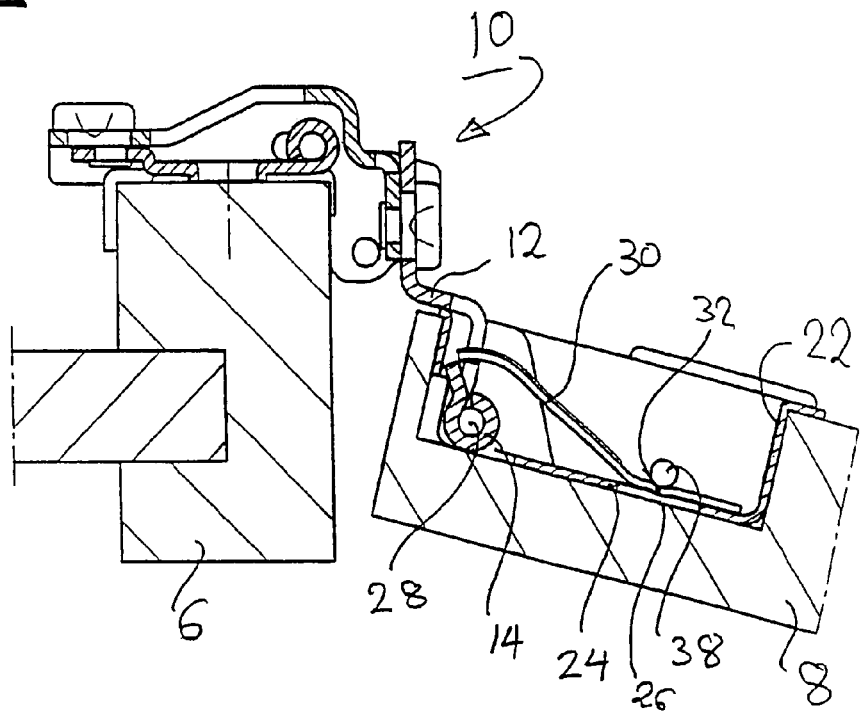
FIG. 3: the hinge of FIG. 1 in a completely open state.
Figure 4:
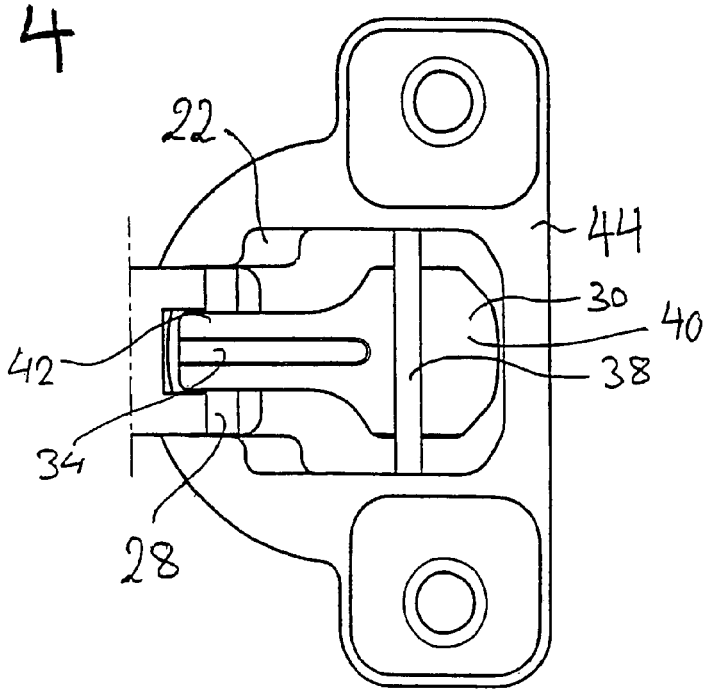
FIG. 4: a plan view of the cup-shaped hinge.

The hinge visible from FIGS. 1 to 3 substantially comprises a hinge arm 12 which is provided with a cranked portion and whose lower rolled-in end 14 encompasses a joint axle 28. The joint axle 28 is non-displaceably held in a customary fashion in the side walls of the hinge cup 22. This hinge cup 22 is inserted in a customary fashion into a flat blind bore, of a door 8, for example, which is pivotably connected to a furniture body 6 via the hinge 10 and is connected thereto by a flange 44 which is part of the hinge cup 22 (cf. FIG. 4).

Figure 7:
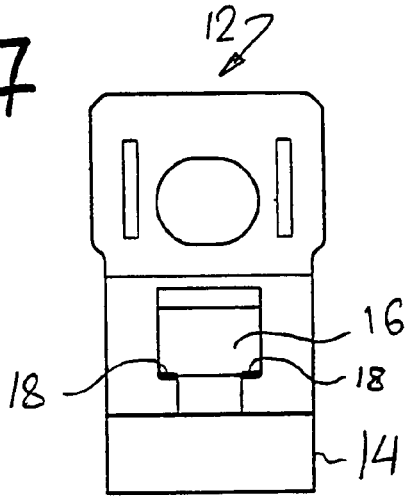
FIG. 7: a plan view of the hinge arm.
Figure 8:
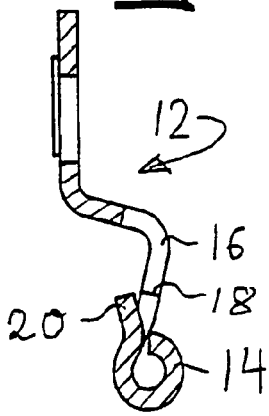
FIG. 8: a sectional view of the hinge arm of FIG. 7.

The cranked hinge arm 12 is shown in an isolated representation in FIGS. 7 and 8. This hinge arm 12 has, as already stated above, a central recess 16, from whose lower edge a tongue 20 is cut out, at its lower rolled-in end 14 which encompasses the hinge axle 28 in the installed state. The width of the tongue 20 is lower than the total width of the recess 16 so that short portions 18 are formed in the lower end region of the recess 16 at both sides of the cut-out and bent-back tongue 20.

As can in particular be seen from FIG. 2, the tongue 20 is offset from the rolled-in end 14 of the hinge arm so that its manufacture is substantially simplified.

As can be seen from FIGS. 1 to 3, a transverse pint 38 is fastened in the side walls of the end of the hinge cup 22 disposed opposite the joint axle 28 and a leaf spring 30 is held between the transverse pin 38 and the base 24 of the hinge cup 22.

In the embodiment shown here, a lower spacing is present between the transverse pin 38 and the base 24 of the hinge cup 22 than that of the thickness of the leaf spring 30. In this region, the base 24 of the hinge cup 22 has a recess 26 whose width corresponds to the leaf spring 30. The leaf spring 30 advantageously has a transversely extending dimple or bead 32 at the part disposed beneath the transverse pin 38, said dimple or bead dipping partly into the recess 26 of the base 24 of the hinge cup 22 and thus holding the leaf spring in its correct and centered position.

Figure 5:
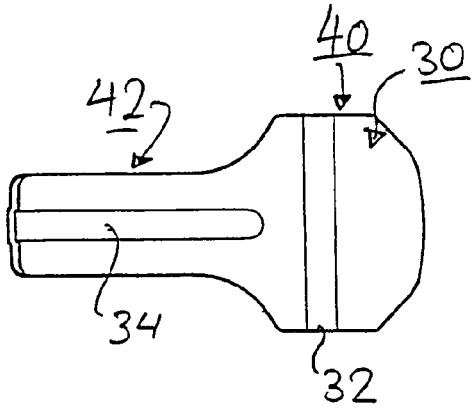
FIG. 5: a plan view of the leaf spring of the hinge.
Figure 6:
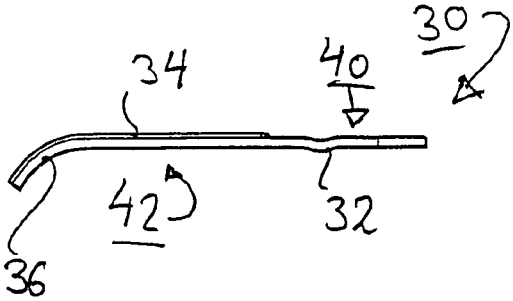
FIG. 6: a side view of the leaf spring of FIG. 5.

The leaf spring 3 is shown isolated in FIGS. 5 and 6. It substantially has two portions 40 and 42. The portion 42 is a narrower portion which merges in a transition region into the wider portion 40 of the leaf spring 30. The narrower portion 42 has a curved end region 36. A rib 34 extends along the narrow portion 42 as a reinforcement rib. It extends up to approx. three-quarters of the length of the transition region between the portions 42 and 40 of the leaf spring 30.

In FIG. 1, the hinge in accordance with the invention is shown in a closed position, that is a door 8 closes an opening of the furniture body 6.

In FIG. 2, the hinge 10 can be seen in its position open by approximately 30°. The tongue 20 slides from this position in the direction of opening along the curved end region 36 of the leaf spring 30 whose radius of curvature corresponds to the spacing of the outer edge of the tongue 20 from the joint axle 28 so that the spring no longer performs any bending in this pivot region of the hinge. However, before the tongue 20 reaches this angular position of 30°, it is supported with respect to the leaf spring 30 such that the leaf spring generates a closing torque in this closing region. In this connection, the rib 34 in the narrower portion 42 has the effect that the strength of this region reinforced by the rib is increased such that the leaf spring 30 is only bent in the region of the transverse pin 38. In this region, the leaf spring is made wider so that a comparatively larger force with a lower bend can be generated here.

In FIG. 3, the hinge is shown in its open position. Since the tongue 20 is manufactured by a simple bending out in a simple manner, it cannot absorb any particularly large support forces of the leaf spring 20. In the open position of the hinge 10, the leaf spring 30 is therefore supported at the edges 18 of the recess 16 of the hinge arm 12 arranged laterally next to the tongue 20. The spacing of these edges from the joint axle 28 substantially corresponds to the spacing of the outer edge of the tongue 20 from this joint axle 28. The support of the spring is therefore passed on to the short portions 18 in the region of the recess 16 of the hinge arm 12 in the opening pivot movement of the tongue 20 in the maximum opened position shown in FIG. 3, with no further bending tension being applied to the leaf spring 30.

In FIG. 9, a representation corresponding to FIG. 3 of an alternative embodiment variant is shown. Unlike the embodiment variant in accordance with FIG. 3, the leaf spring 50 comprises two identical leaf spring parts 50' and 50" of comparatively less thickness (cf. FIG. 10 in which the parts 50' and 50" are shown drawn apart). In this construction, the rib 34 provided in the example in accordance with the embodiment shown in FIG. 3 ff. can be dispensed with. The corresponding dimples or beads 32, which were described in the previous embodiment variant, are no longer present in the embodiment in accordance with FIGS. 9 to 12.

As can furthermore be seen from FIG. 9, the transverse pin 58 has an out-of-round cross-section, is hereby reinforced and can no longer be deflected so easily. As results in particular from FIGS. 11 and 12, the hinge arm 52 is shaped in its curved part such that outwardly offset edges 54 adjoin the center part 56, with this center part being provided with a recess 16.

The invention claimed is:

1. A hinge, comprising:

a hinge arm which is pivotably supported on a joint axle, the joint axle is non-displaceably held in a cup-shaped hinge part, and the hinge arm is provided with a tongue which projects beyond the joint axle and slides on a first end region of a leaf spring, a second end region of the leaf spring is held at the cup-shaped hinge part and generates a closing torque, where the hinge arm has a center recess having a lower edge from which the tongue is cut out; and where the first end region of the leaf spring passes through the center recess of the hinge arm.

2. A hinge in accordance with claim 1, wherein the hinge is a furniture hinge, and where the leaf spring has at least two portions of different widths, with at least one narrower portion of the leaf spring passing through the center recess of the hinge arm and at least one wider portion of the leaf spring being pressed against a base of the hinge cup and being fixedly held by a transversely extending pin.

3. A hinge in accordance with claim 2, wherein the at least one narrower portion of the leaf spring has a longitudinally formed rib tip extending to a transition region of the at least one wider portion of the leaf spring.

4. A hinge in accordance with claim 3, wherein the base of the hinge cup has a recess in the region in which the at least one wider portion of the leaf spring is arranged.

5. A hinge in accordance with claim 4, wherein a spacing between the transverse pin and the base is smaller than the thickness of the leaf spring.

6. A hinge in accordance with claim 5, wherein the leaf spring has a transversely extending dimple at its region disposed beneath the transverse pin, said dimple dipping into the recess of the hinge cup.

7. A hinge in accordance with claim 6, wherein the longitudinally formed rib extends up to ¾of the length of the transition region between the at least two portions of the leaf spring.

8. A hinge in accordance with claim 7, wherein the tongue is cut out of the lower edge of the center recess such that the lower edge of the center recess has two portions next to the cut-out tongue on which the leaf spring is supported in a fully opened position of the hinge.

9. A hinge in accordance with claim 8, wherein a spacing of the two portions from the joint axle is equal to or only slightly larger than a spacing of the outer edge of the tongue from the joint axle.

10. A hinge in accordance with claim 2, wherein the leaf spring has a curved end region in the a region of the at least one narrower portion of the leaf spring.

11. A hinge in accordance with claim 10, wherein the hinge arm has edges in a curve end region of the hinge arm which are shaped such that they are offset with respect to a center part of the hinge arm provided with the center recess.

12. A hinge in accordance with claim 2, wherein the transverse pin has an out-of-round cross-section.

13. A hinge in accordance with claim 1, wherein the leaf spring comprises two identical leaf springs of small thickness.

14. A system, comprising: a furniture body; a door; and a furniture hinge, comprising a joint axle which is non-displaceably held in a cup-shaped hinge part; a hinge arm which is pivotably supported on the joint axle, the hinge arm having a center recess with a lower edge; a leaf spring having a first end region and second end region, the second end region held at the cup-shaped hinge part and which generates a closing torque in the closing region, and the first end region of the leaf spring passing through the center recess of the hinge arm; and a tongue which projects beyond the joint axle and slides on the first end region of the leaf spring, where the tongue is cut out from the lower edge of the center recess, where the cup-shaped hinge part is coupled to the door, the door pivotably connected to the furniture body via the furniture hinge.

15. The system of claim 14, wherein the leaf spring has at least two portions of different widths, with at least one narrower portion of the leaf spring passing through the center recess of the hinge arm and at least one wider portion of the leaf spring being pressed against a base of the hinge cup and being fixedly held by a transversely extending pin.

16. The system of claim 15, wherein the at least one narrower portion of the leaf spring has a longitudinally formed rib extending to a transition region of the at least one wider portion of the leaf spring, the base of the hinge cup has a recess in the region in which the at least one wider portion of the leaf spring is arranged, and a spacing between the transverse pin and the base is smaller than the thickness of the leaf spring.

17. he system of claim 16, wherein the leaf spring has a transversely extending dimple at its region disposed beneath the transverse pin, said dimple dipping into the recess of the hinge cup, the longitudinally formed rib extends up to ¾of the length of the transition region between the at least two portions of the leaf spring, and the tongue is cut out of the lower edge of the center recess such that the lower edge of the center recess has two portions next to the cut-out tongue on which the leaf spring is supported in a fully opened position of the hinge.

18. The system of claim 17, wherein a spacing of the two portions from the joint axle is equal to or only slightly larger than a spacing of the outer edge of the tongue from the joint axle.

19. The system of claim 15, wherein the leaf spring has a curved end region in a region of the at least one narrower portion of the leaf spring, and where the transverse pin has an out-of-round cross-section.

20. The system of claim 19, wherein the hinge arm has edges in a curved end region of the hinge arm which are shaped such that they are offset with respect to a center part of the hinge arm provided with the center recess.

* * * * *

UNITED STATES PATENT AND TRADEMARK OFFICE

CERTIFICATE OF CORRECTION

PATENT NO. : 7,966,695 B2
APPLICATION NO. : 11/886386
DATED : June 28, 2011
INVENTOR(S) : Luciano Salice It is certified that error appears in the above-identified patent and that said Letters Patent is hereby corrected as shown below:

In Claim 6:

On Line 34, remove --at its region--.

In Claim 7:

On line 38, add a space between "3/4" and "of".

In Claim 10:

On line 51, remove --the-- after "in".

In Claim 14:

On line 13, remove --in the closing region--.

In Claim 17:

On line 34, remove --he-- and add --The-- before the word "system".
On line 35, remove --at its region--.
On line 37, add a space between "3/4" and "of".

Signed and Sealed this
Tenth Day of January, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,966,695 B2
APPLICATION NO. : 11/886386
DATED : June 28, 2011
INVENTOR(S) : Luciano Salice It is certified that error appears in the above-identified patent and that said Letters Patent is hereby corrected as shown below:

Column 5, line 34 (Claim 6, line 2)
remove --at its region--.

Column 5, line 38 (Claim 7, line 2)
add a space between "3/4" and "of".

Column 5, line 51 (Claim 10, line 2)
remove --the-- after "in".

Column 6, line 13 (Claim 14, line 8)
remove --in the closing region--.

Column 17, line 34 (Claim 17, line 1)
remove --he-- and add --The-- before the word "system".

Column 17, line 35 (Claim 17, line 2)
remove --at its region--.

Column 17, line 37 (Claim 17, line 4)
add a space between "3/4" and "of".

This certificate supersedes the Certificate of Correction issued January 10, 2012.

Signed and Sealed this
Fourteenth Day of February, 2012

David J. Kappos

David J. Kappos
*Director of the United States Patent and Trademark Office*